US012338029B2

(12) United States Patent
Tattam et al.

(10) Patent No.: US 12,338,029 B2
(45) Date of Patent: Jun. 24, 2025

(54) TRANSPORT AND STORAGE ENCLOSURE

(71) Applicant: Softbox Systems Limited, Long Crendon (GB)

(72) Inventors: Edwin Francis Tattam, Long Crendon (GB); James Nathan Jarvis, Long Crendon (GB)

(73) Assignee: Softbox Systems Limited, Long Crendon (GB)

( * ) Notice: Subject to any disclaimer, the term of this patent is extended or adjusted under 35 U.S.C. 154(b) by 0 days.

(21) Appl. No.: 18/016,534

(22) PCT Filed: Jul. 19, 2021

(86) PCT No.: PCT/EP2021/025267
§ 371 (c)(1),
(2) Date: Jan. 17, 2023

(87) PCT Pub. No.: WO2022/012781
PCT Pub. Date: Jan. 20, 2022

(65) Prior Publication Data

US 2023/0271750 A1 Aug. 31, 2023

(30) Foreign Application Priority Data

Jul. 17, 2020 (GB) ..... 2011094

(51) Int. Cl.
*B65D 19/06* (2006.01)
*B65D 19/38* (2006.01)

(52) U.S. Cl.
CPC ..... *B65D 19/06* (2013.01); *B65D 19/385* (2013.01); *B65D 2519/00159* (2013.01);
(Continued)

(58) Field of Classification Search
CPC ..... B65D 19/06; B65D 19/385; B65D 2519/00537; B65D 5/32; B65D 77/0466; B65D 5/48
(Continued)

(56) References Cited

U.S. PATENT DOCUMENTS 4,019,634 A * 4/1977 Bonnot ..... B65D 19/06 229/199
4,177,715 A * 12/1979 Meyers ..... B65D 25/04 493/90

(Continued)

FOREIGN PATENT DOCUMENTS

WO WO 2015/181515 A1 12/2015
WO WO 2016/156418 A1 10/2016

OTHER PUBLICATIONS

International Search Report and Written Opinion dated Nov. 18, 2021, for International Application No. PCT/EP2021/025267, 10 pages.

*Primary Examiner* — Ernesto A Grano
*Assistant Examiner* — Symren K Sanghera
(74) *Attorney, Agent, or Firm* — Frost Brown Todd LLP

(57) ABSTRACT

The present invention relates to the field of the transportation and storage of goods, to a modular container for shipping and handling cargo and to a storage system therefor, and to such a container that may be easily assembled or disassembled. In particular, but not necessarily restricted thereto, the present invention relates to a system for the transportation and storage of palletized goods.

11 Claims, 11 Drawing Sheets

(52) U.S. Cl.
CPC ..... *B65D 2519/00174* (2013.01); *B65D 2519/00497* (2013.01); *B65D 2519/00537* (2013.01)

(58) Field of Classification Search
USPC ..... 206/597
See application file for complete search history.

(56) References Cited

U.S. PATENT DOCUMENTS

| | | | | | |
|---|---|---|---|---|---|
| 5,316,210 | A * | 5/1994 | Scullin | B65D 5/48048 | 229/172 |
| 5,492,267 | A * | 2/1996 | Hollander | B32B 3/12 | 428/116 |
| 5,967,406 | A * | 10/1999 | Moorman | B65D 5/324 | 206/427 |
| 6,386,366 | B1 * | 5/2002 | Friedman | B65D 5/32 | 206/774 |
| 8,511,471 | B1 * | 8/2013 | Sannah | B65D 5/48024 | 229/199 |
| 2013/0126373 | A1 * | 5/2013 | Wadsworth | B65B 5/10 | 53/471 |
| 2020/0399014 | A1 * | 12/2020 | Shuert | B65D 19/38 | |
| 2023/0271750 | A1 * | 8/2023 | Tattam | B65D 71/0096 | 206/597 |

* cited by examiner

Figure 1a
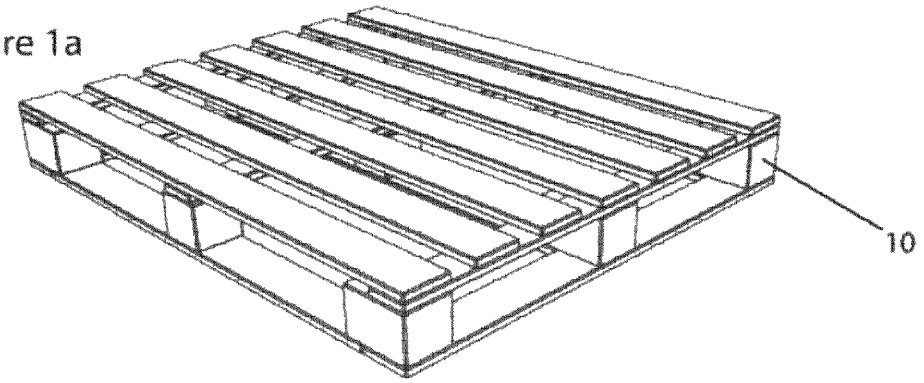
Figure 1b
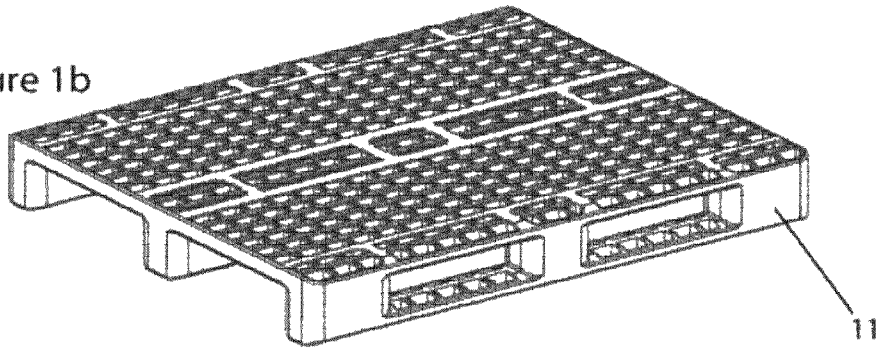
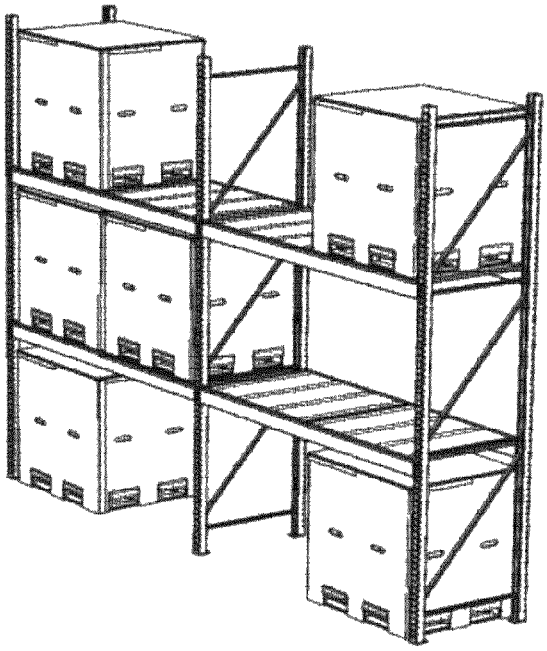
Figure 2a

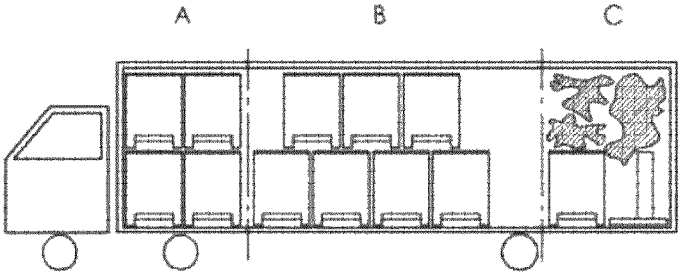
Figure 2b
Figure 2c
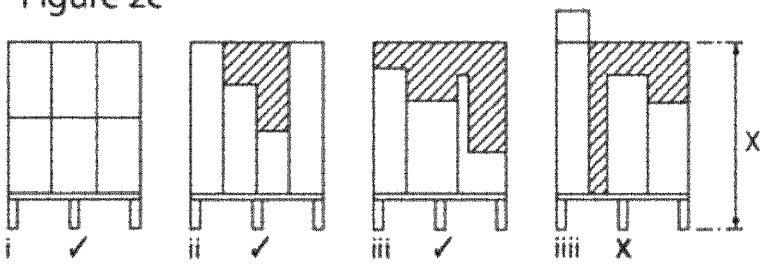
Figure 3a
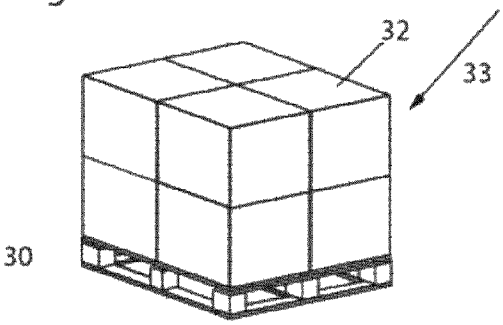
Figure 3b
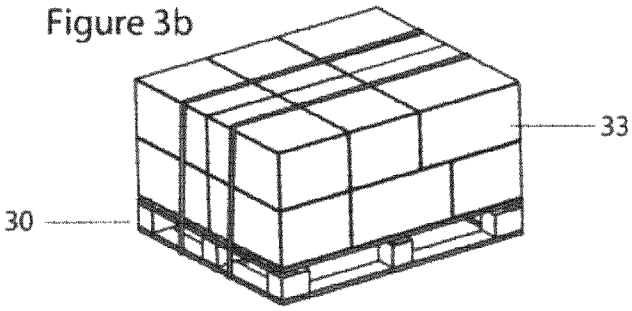
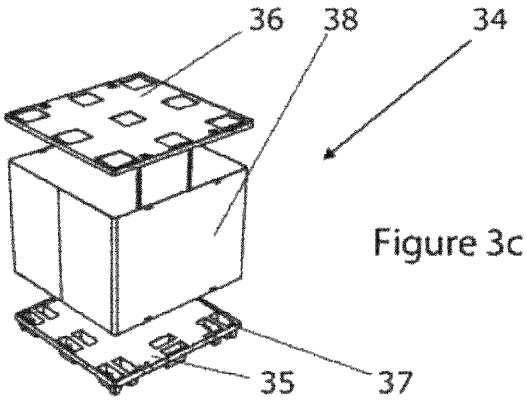
Figure 3c Figure 6d
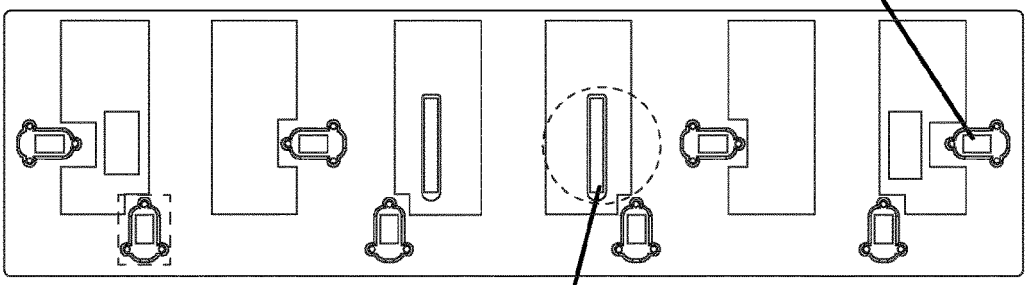
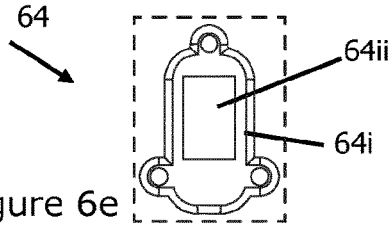
Figure 6e
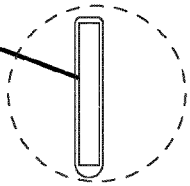
Figure 6f
Figure 6g
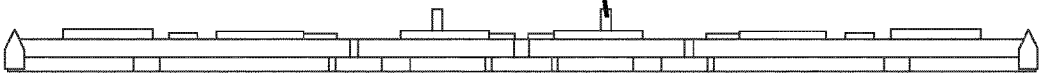
Figure 6h
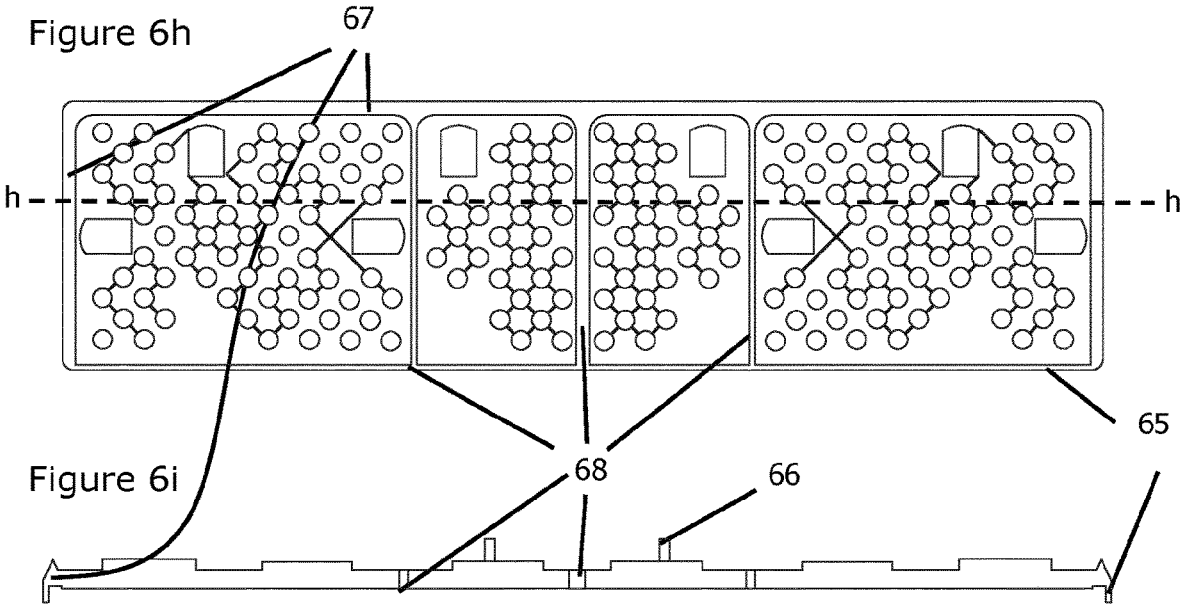
Figure 6i

TRANSPORT AND STORAGE ENCLOSURE

This application claims priority to and the filing benefit of International App. No. PCT/EP2021/025267, entitled "TRANSPORT AND STORAGE ENCLOSURE", filed on Jul. 19, 2021, which claims priority to and the filing benefit of GB2011094.6 filed on Jul. 17, 2020.

FIELD OF INVENTION

The present invention relates to the field of the transportation and storage of goods, to a modular container for shipping and handling cargo and to a storage system therefor, and to such a container that can be easily assembled or disassembled. In particular, but not necessarily restricted thereto, the present invention relates to a system for the transportation and storage of palletized goods.

BACKGROUND TO THE INVENTION

In the field of logistics, that is the field of movement and supply of produce and materials, the transportation of intermediate and finished products is frequently assisted by the use of pallets. A pallet typically comprises a flat rectangular structure that supports goods in a stable fashion whether remaining in a transport vehicle—such as a lorry, container etc., a warehouse, storage area etc. or being lifted by a forklift, pallet truck, front loader, or other handling device. Pallets are commonly found in a wide range of industries and services, forming an essential part of many mechanical handling systems in factories, distribution warehouses and the like.

Pallets are manufactured from a variety of materials, most commonly from: timber 10 per FIG. 1*a*; plastics 11 per FIG. 1*b*; and also paper/fibreboard and sometimes from metal. Wooden pallets typically consist of three or four support stringers that support several deckboards, on top of which goods are placed. Square or nearly square pallets help a load resist tipping. Goods or shipping containers are often placed on a pallet secured with strapping, stretch wrap or shrink wrap and shipped.

Pallets make it easier to move heavy stacks and are extremely adaptable, not being limited to specific dimensions of height, weight or bulk size as such. Loads with pallets under them can be hauled by forklift trucks and pallet trucks of different sizes. Not only are there grades of durability, heavy weights need to be supported by sufficiently strong pallets. Most pallets can easily carry a load of 1,000 kg (2,205 lb.), although, operators must be aware that lightweight pallets may be provided for less significant loads and the load rating must always be confirmed prior to use, given that group transport organisations exist, where pallet products are shared between groups of users, for different types of goods. A working maximum weight is typically 1,000 Kg, being limited inter alia, by the capabilities of handling equipment and health and safety issues.

In some areas of logistics, it has been found that the pallet has become the structural foundation of a unit load which allows handling and storage efficiencies. Further, the extensive use of 40' and 20' containers for transport has spurred the use of pallets because such shipping containers provide smooth and level surfaces suitable for easy pallet movement and bulk stacking of a large number of palletized loads. It is presently understood that, over half a billion pallets are made each year and about two billion pallets are in use across the United States, for example.

Typical pallet sizes are: 1200×800 mm; 1200×1000 mm; 1200×120 mm; being three of six ISO (International Standards Organization) sanctioned standard pallets, although there is a plethora of different sizes for specific tasks, globally. The fork tines of a fork lift or other lifting device may have limited access to a pallet, being limited to only one side, to two sides or can be provided on all four sides (1-, 2-, or 4-way entry). Pallets are reusable packaging items. Every pallet that is built could potentially be used and used again until such a time when it will need to be replaced. The lack of a single international standard for pallets causes substantial continuing expense in international trade. A single standard is difficult because of the wide variety of needs a standard pallet would have to satisfy: passing by or through doorways, placing within standard containers and unit load devices (ULDS), noting that weight, size and bulk affect the use of a standard type of load and use of a standard can reduce labour costs.

In order to maximise the storage capacity of a warehouse pallets are placed upon pallet racks, as shown in FIG. 2*a*; the common frame comprising at least four vertical posts is fitted with beams that can be connected at various levels to the posts, whereby to provide racking systems which can be adjusted in height to provide a number of support platforms each for individual pallets. Whilst pallets can be stacked one atop another, this can be inconvenient; stabilization can be required and, not infrequently, can be hazardous, with a risk of breakage of goods through poor handling and a potential collapse over time.

In another area of use, notably with regard to commercial vehicles, especially of the curtain sided type, reference is made to FIG. 2*b*. The individual pallets must either have boxes of sufficient strength to support the weight of another pallet, when stacked vertically per load "A", taking into account the basic capability of the lower pallets to support further palletized loads, with regard to a flat upper surface, ability/integrity to take further weight etc.; ideally the load of an upper pallet is spread upon two lower pallets, which provides a greater degree of stabilization, per load "B"; load "C" comprises a disparate array of a base level placement of pallets, with the volume above the pallet having loosely placed goods, although there will be instances of there being no higher stacking or no such further loosely placed load, increasing the unit cost of freight. Additionally, the goods will need to be made secure with straps, locking catches etc. which are not detailed in this Figure, given that when a commercial vehicle goes around a corner, centrifugal forces will apply to the loads; the higher a load is situated, the greater the effect of such forces shall be. FIG. 2*c* i-iii show how loads can be accompanied within a standard pallet height X. Notably, and as shown in FIG. 2*c* iiii, an unusual load can cause problems in logistics, when a standard height pallet cannot be used; no stacking is possible etc.

FIG. 3*a* shows a pallet with four boxes 32 placed thereon. However, many pallets are loaded with goods such that it is not intended to have further pallets stacked upon a first pallet, such as the case of the pallet 30 per FIG. 3*b*, which is loaded with a load 33 in a central area of the pallet 30, or where shrink/stretch plastics has been wrapped about a load, whilst providing greater security, minimising the possibility of movement of the goods in transit, can dispense with any sides to a palletized load, preventing any possibility of stacking. Additionally, once placed upon a lower pallet, it is frequently the case that the pallet needs to be slid or offset across the tops of one or more pallets. For example with a curtain sided lorry a fork lift driver may not have been correct in the order of pallets being placed upon a truck and it may be desired to shift the loaded pallet sideways. Another variation of container that is particularly common is the pallet box. Otherwise known as a pallbox, where a wooden or plastics pallet is enclosed by a cardboard box; indeed, the base may include heavy duty, multiple-wall corrugated material that acts as a pallet, but these are formed in the shape of bins, which of themselves do not assist in unloading. Moreover, pall-boxes do not permit removal of any pallet and any goods thereon from the pall-box.

Most cargo shipping containers define a square or rectangular enclosure within which a desired cargo may be carried. Such containers may be constructed from a base pallet, sidewalls, and a top pallet which may be assembled into a container that defines a fully enclosed space. Empty shipping containers are bulky and hard to store, as they consist of rigid walls defining an empty space. Thus, to minimize the storage space necessary for empty containers and to facilitate easy handling, shipping containers have been constructed of modular components which may be disassembled and stored separately. The base pallet, sidewalls, and top pallet are often stackable, foldable or are otherwise designed to allow compact storage.

OBJECT OF THE INVENTION

The present invention seeks to provide a solution to the problems addressed above. The present invention seeks to provide a system that can enable goods to be securely and reliably horizontally, vertically and offset stacked, despite different sizes of support members such as pallets, whereby wasted volumes arising from the presence of irregular loads, pallets or pallets of different levels or different load ratings in storage and transport can be minimized. Furthermore, the present invention seeks to provide a system for pallet-borne goods that protects the goods, enables stacking and maximise the use of transport volume associated with a transport vehicle or storage volume associated with a stores for goods.

STATEMENT OF INVENTION

In accordance with a general aspect of the invention, there is provided a transport/storage enclosure for enclosing a product with respect to a support surface, the enclosure comprising a four sided form arranged as a general rectangular body, with five external panels, having a length and a width; the assembly comprising at least first and second rectangular sheet products, each comprising first and second fold lines whereby to produce a panel having three rectangular wall sections, respectively first, second, and third rectangular sections, wherein the first and second sheet materials, upon assembly are arranged such that they comprise two sheet elements having a cross-section of a general "C"-shape, with the first and third arms of the sheet products defining an opening, which respective openings face each other to define a rectangular enclosure; the assembly further comprising a third rectangular sheet product, comprising first and second fold lines whereby to produce a panel having three rectangular wall sections, respectively first, second, and third rectangular sections, wherein the third sheet materials, upon assembly is arranged such that it comprises a sheet element having a cross-section of a general "C"-shape, the length of the central section being less than the corresponding section of the first and second sheet products, with the length of the first and third panels being less than the corresponding section of the first and second sheet products, whereby the third sheet product divides the enclosure, with the first and third wall sections being placed parallel to the corresponding wall sections of the first and second rectangular sheet products; the enclosure further comprising a lid which closes rectangular arrangement, the lid having a downwardly depending lip about its perimeter and channels operable to engage with the upstanding edges of the sheet product elements, to define an upright rectangular quadrangle arrangement operable to surround two or more pallets and any load carried thereon, the lid being of a two part construction, with the two parts being separable along a partition along the length. By having a single enclosure around two or more pallets, the loading of a vehicle can be performed with fewer operations by operator personnel, achieving quicker turnaround. By providing an upper support surface, an effective load space of a vehicle can be doubled.

Conveniently, a single third rectangular wall section is provided wherein the central section of the third rectangular wall section is operably arranged adjacent first and third, coplanar sheets, with the first and third panels act as divider partitions between, respectively first and second and second and third enclosures for palletized goods, the uppermost portions of the sheets engaging within the lid member. This system can be converted such that the central section of the third rectangular wall section is operably arranged adjacent first and third, coplanar sheets of the exterior walls of the enclosure, and folded back whereby to permit the first and third sheet panels of the third rectangular wall portion to extend perpendicularly, whereby to jointly act as a divider partition between first and second enclosures for palletized goods, the uppermost portions of the sheets engaging within the lid member. Preferably, a further panel depends from at least one of the first and third panels of the third rectangular sheet portion, whereby to fully enclose at least one of the divided interior sections.

Alternatively, there are two third rectangular wall sections provided, each arranged such that there is a central section, with two depending sections each other side of the central wall section, whereby to provide a general "C"-shape in plan, wherein the central sections are operably arranged facing each other such that in a first mode of operation there are arranged such that the C-sections face each other whereby to divide the enclosure into three distinct interior sections and in a second mode of operation are arranged in such that the "C"-sections are facing way from each other whereby to divide the enclosure into two distinct interior sections.

The enclosure in accordance with the present invention can be simply made with a thermoformed plastics lid and wherein the upstanding walls are formed from one of corrugated cardboard, corrugated plastics, multilayer plastics and of extruded plastics. Such plastics can not only be re-used many times, by the use of easily recyclable plastics, at the end of life stage can be simply re-purposed.

In accordance with the invention, by having the lid comprises of two portions, each extending across the longer dimension of the enclosure, whereby removal of one lid element permits the enclosure to remain secure yet permit the walls of one side of the enclosure to be hingedly opened, to enable access to the enclosure. Conveniently, the lid has a channel defined on an inside surface, whereby to assist in location of the upstanding walls. Conveniently the lid comprises two equal-sized components, whereby a single mould can provide the lid for a specific plan of enclosure. Notwithstanding this, the arrangement of lid structure may be such that along one edge, the lid is pivotable or removable so as to permit the walls of one side of the enclosure to be hingedly opened.

Conveniently, the walls of the enclosure are provided with apertures and are spaced about the edges and the lid is provided with slide bolts operable to engage with apertures placed proximate to the upstanding edges of the sheet product elements. The slide bolts can be provided with engagement means operable to secure tamper evident ties. Additionally or alternatively, the slide bolts are provided with locking means operable to secure the lid to the sheet product elements. Additionally, the lid may be provided with bolts on an uppers surface whereby to engage with apertures placed along a lower sidewall of a second enclosure of the invention placed upon a first enclosure in accordance with the invention.

By having an enclosure formed from sheet materials, then they can simply be folded flat when not in use, whereby the actual useful storage space of a warehouse, racking system, loading bay, lorry, train wagon or other form of ground/working area support surface can be increased. In a commercial vehicle delivery system, pallets loads can be protected and stacked; equally non-palletized loads can be protected and stacked; whilst on a return journey a totally different type of load can be transported with the inventive sleeves being stored with a reduced space configuration whereby to assist in a logistics business.

The sheet materials employed for the fabrication of the rectangular sheet can be corrugated cardboard, corrugated plastics, extruded plastics and multi-layer plastics sheet. Cardboard can be employed, for example in a number of types and sheet cardboard sheet material can be selected from single, double, triple or quadruple corrugated cardboard. Such cardboard can be treated, by wax, resin, paint or other known waterproofing methods. Additionally, such cardboard can be provided with corrugation flutes is strengthened by the use of strengthening materials inserted into the corrugation flutes, comprising elongate support members or strengthening members, such as epoxy-resin or thermosetting resin, plastics rod, metal and wood. Preferably thermoplastics materials, such as polyurethane are formed into corrugated sections, conveniently of three or more wall sections. Even more preferably, panel wall sections of three layers of corrugate material with an aerated corrugate. Instead of die-board cutting of cardboard, apertures can be defined using heat; bespoke size panels can be created using mirror welding techniques, as is known.

The base support surface upon which transport/storage assembly is placed is typically, but could comprise one of a ground surface (generally), a floor associated with one of a support bench/storage-racking system associated a stores area, a workshop/office/storage area, a vehicle flat-bed, being a floor of a transport vehicle and a cover of another transport/storage assembly. By having an enclosure which can be folded in a flat fashion when not in use, the actual useful storage space of a warehouse, racking system, loading bay, lorry, train wagon or other form of ground/working area support surface can be increased.

An enclosure assembly in accordance with the present invention may be assembled in a rapid and expeditious manner. The three parts making up the enclosure assembly may be stacked for storage in a relatively small space, conveniently being prior attached to a panel for a container, and may be associated with a container also arranged in a flat-pack style.

BRIEF DESCRIPTION OF THE FIGURES

For a better understanding of the present invention, reference will now be made, by way of example only, to the Figures as shown in the accompanying drawing sheets, wherein:-

FIGS. 1*a*-1*b* illustrate two known forms of pallet;

FIGS. 2*a* and 2*b* illustrate an arrangement of pallets upon racks and within a commercial vehicle;

FIGS. 2*c.i*-2*c.iiii* show how pallets are typically loaded;

FIGS. 3*a-c* show prior art pallet systems;

FIGS. 6*d*-6*i* detail a second enclosure lid and

DETAILED DESCRIPTION OF THE PREFERRED EMBODIMENTS

There will now be described, by way of example only, the best mode contemplated by the inventor for carrying out the present invention. In the following description, numerous specific details are set out in order to provide a complete understanding to the present invention. It will be apparent to those skilled in the art, that the present invention may be put into practice with variations of the specific.

Figure 4:
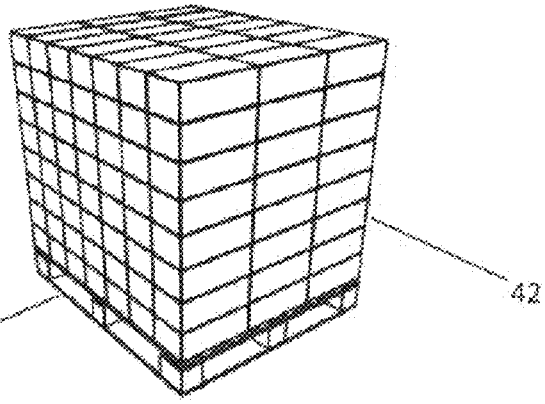
FIG. 4 shows a loaded pallet.

FIG. 4 shows an example of a pallet 20 supporting a load 42; the load placed upon the pallet so that the outer extent of the load corresponds with the area of the pallet base. Whilst the pallet 20 is not shown in any great detail, it is manufactured from wood and is a four-way entry pallet, wherein the tines of a fork lift or similar tined lifting device can insert its tines through gaps typically having a lowermost height of 100-120 mm, but this will vary, dependent upon the material of manufacture of the pallet and the load to be supported.

Figure 5A:
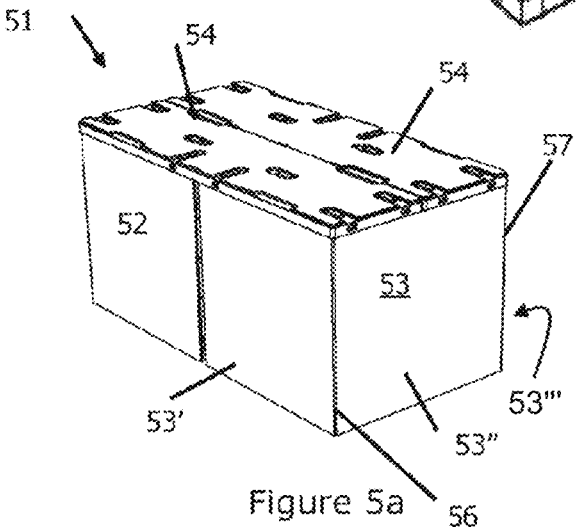
FIGS. 5*a* & 5*b* show a first embodiment of the invention in side and front perspective views, respectively.
Figure 5B:
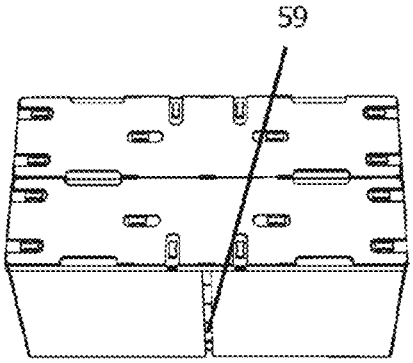
Figure 5C:
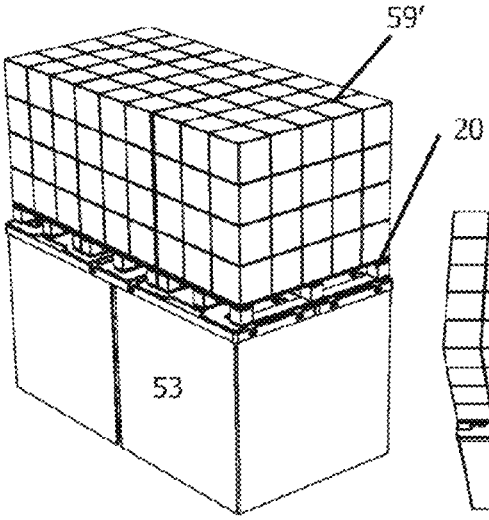
FIGS. 5*c* & 5*d* show the first embodiment of the invention in side and front perspective views, respectively with a secondary load placed upon the enclosure.
Figure 5D:
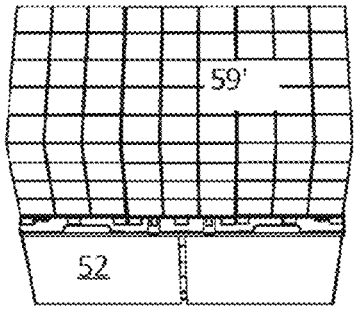

FIG. 5*a* shows a first embodiment of the invention 51, in a state of completion showing first and second exterior panels 52, 53—each comprising an elongate rectangular sheet of corrugated board, with the corrugations of the board extending transversely to the longer dimension of the rectangular board. Two transverse creases 56, 57, parallel with the corrugations enable the panel to be folded into three sections, 53', 53" & 53"; upon erection, a long edge of the panel is placed upon the support surface—which could be a warehouse floor, the flatbed of a lorry or another enclosure in accordance with the invention—such that sections 53', 53" & 53'" are arranged in a general "C" fashion shape to define a rectangular cuboid enclosure constructed from three sheet material components 56, 57 & 59. The lid elements 54 are provided with locking systems 58 which enable them to locate with apertures present in the panels 52, 53, as shall be discussed in greater detail below. In FIG. 5*b*, there is a gap between adjacent panels 52 and 53; goods 59 are effectively enclosed. It will be appreciated that the goods may well have packaging present to obscure the type of good retained with the enclosure; equally dependent leaves could be provided whereby to ensure that the nature of the packaging or the goods 59 are not visible. FIGS. 5*c* and 5*d* show how the enclosures 51, as seen from side perspective and front perspective views can support a load 59' upon a pallet 20.

Figures 6A, 6B:
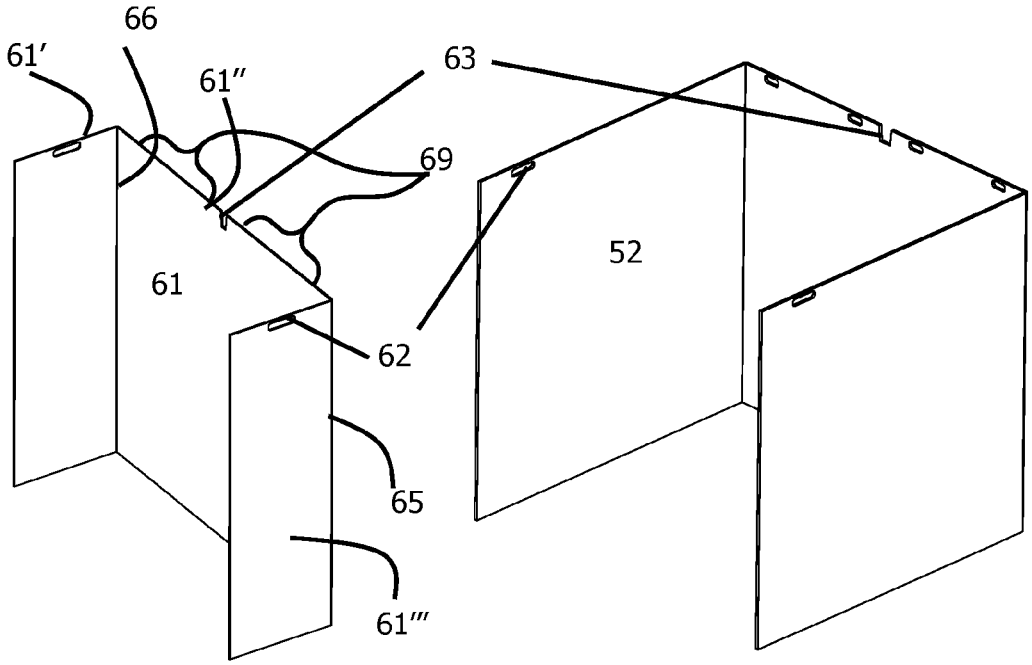
FIGS. 6*a*-6*b* show the two separate corrugated board types of component that are utilised in the manufacture of an enclosure in accordance with the invention.
Figure 6C:
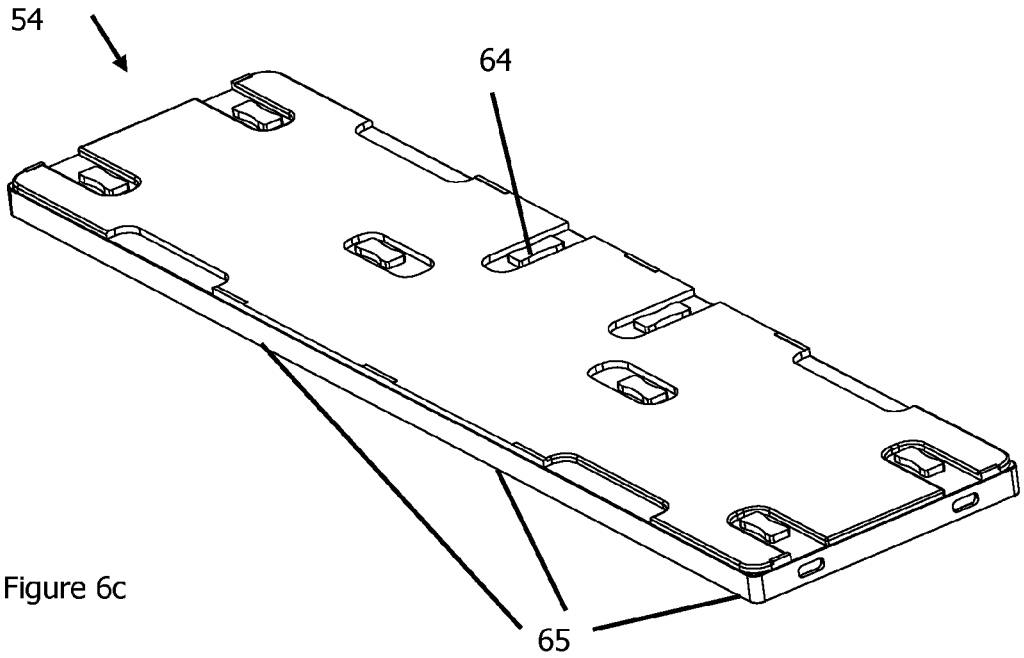
FIG. 6*c* shows an upper main face of a first enclosure lid made in accordance with the invention.

Referring now to the upright sheets of rectangular corrugated board as shown in FIGS. 6*a* and 6*b*-noting that FIG. 6*a* shows a panel corresponding to the external panels 52, 53 as shown above: in addition there is a further rectangular panel 61, also comprising an elongate rectangular sheet of corrugated board, with the corrugations of the board extending transversely to the longer dimension of the rectangular board. Two transverse creases 65, 66, parallel with the corrugations enable the panel to be folded into three sections, 61', 61"& 61' ". This member is used as an internal division and structural support member, which can also assist in identification, by having a container enclosure identification and compartment identification. With reference to FIGS. 6*c* and 6*d*, a lid 54 is shown--noting that two lids are employed in the embodiment shown in FIGS. 5*a* and 5*b*--which has slide control elements 64 on an upper surface of the lid.

FIG. 6*d* shows a second type of lid 54 in accordance with a variant of the invention: with this model, there is only one slide locking element 64 on the short side of the lid. FIG. 6*e* details the slide lock 64 having a slide bolt element 64*ii* retained by housing 64*i*. FIG. 6*f* details in plan view a hand hold band 66 conveniently formed from an elastomeric plastics material, but could be formed from canvas or other similar fabrics/materials. FIG. 6*g* shows a side view of the lid 54. FIGS. 6*h* and 6*i* show an underside view of the lid 54 and a section on line h—h, respectively. A peripheral channel 67 is shown on an inside surface of the lid 54, which are arranged to accept the upstanding edges of wall elements 52 & 53. Reference numeral 68 indicates a further channel to enable the upstanding portions 69 of panel 61" to engage with an inside face of the lid 54, of the internal support and divider panel, for example. The inside of the channel can be provided with resilient means and/or the protrusions to engage with corrugate panels, to reduce any flexing that may occur when the enclosure is placed upon a relatively flexible flatbed of a vehicle, for example. It will be noted that a slide bolt mechanism (or similar functional equivalent) is arranged so as to engage with the apertures 62 just under the top edge of the upstanding wall members 52, 54, & 61. There are also placed "U"-shaped indentations 63 along the middle top edge of the upstanding elements 52, 61, which are situated to permit, for example, a depending corner edge of the lid to pass around the edge panel 52"; equally the "U"-shaped indentation 61 along the upper edge of panel 51" permit a mid length depending part of the lid to pass within such "U"-shaped groove. Nevertheless, it has not proven to be essential that a lock in the central channel 67 is provided, but such a locking system could be provided if necessary, for example through customer choice. FIG. 6*i* also indicates the handle 66 provided to assist in handling of the lid components. Whilst the total weight of the panel is not great—in the region of 2-10 Kg—being dependent upon the anticipated loads, a width of approximately 2.5 m and a depth of some two thirds of a meter, the spaced apart handles can assist in enabling the lid to be easily manageable as a product that will be handled by personnel in use.

Figure 7A:
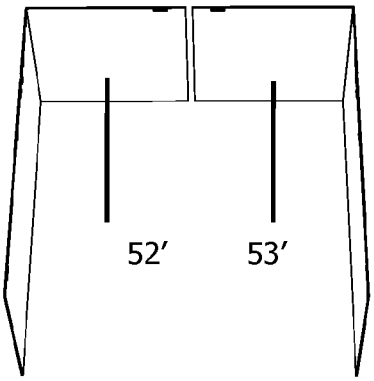
FIGS. 7*a*-7*n* show the steps of assembly and loading an enclosure in accordance with two embodiments in accordance with the present invention.
Figure 7B:
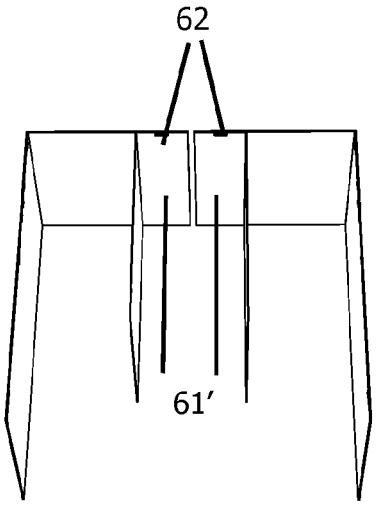
Figure 7C:
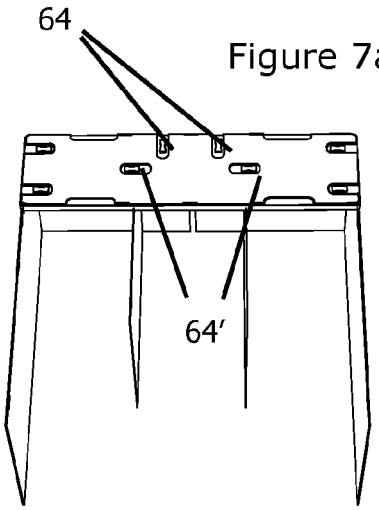
Figure 7D:
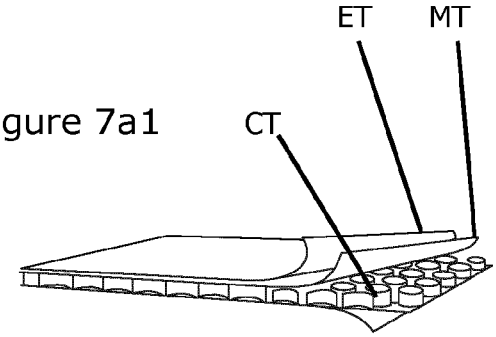
Figure 7D:
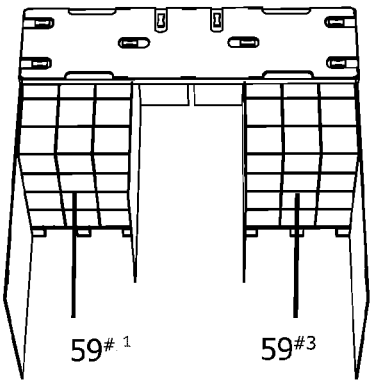
Figure 7E:
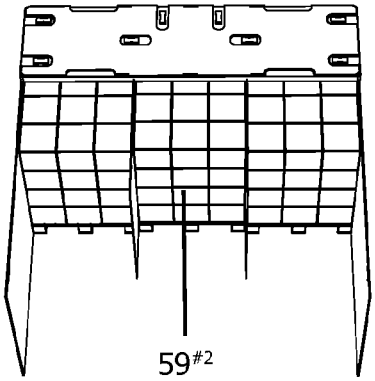
Figure 7F:
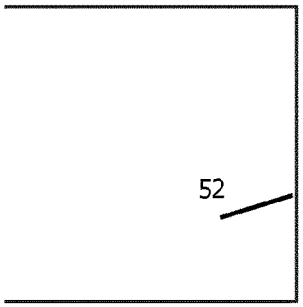
Figure 7G:
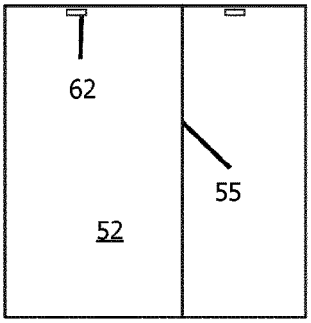
Figure 7H:
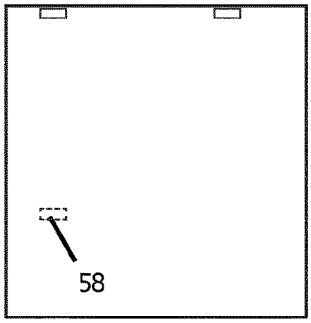

FIG. 7*a* show how the two main external upstanding corrugated sheet material members 52, 53. With respective far panels 52', 53' arranged in a coplanar fashion, each being perpendicular to corresponding mid panels 52", 53" about respective hinge creases 57. FIG. 7*b* differs in that two upstanding inside division and support corrugate sections 61 are employed to enable three compartments to be defined, noting that the first elements 61' are placed in a coplanar fashion against the inside faces of corresponding external wall sections 52' and 53' such that the apertures 62 are in correspondence, such that when the lid element 54 is placed over—per FIGS. 7*c* & 7*d*, the slide bolts can engage through the corresponding apertures 62. A striking plate can be provided to assist in engagement, conveniently bevelled to ensure that the bolt is urged through the aperture 62. FIG. 7*c* show how first and third palletized goods 59$^{\#1}$ and 59$^{\#3}$ can be place at opposite ends of the enclosure, with FIG. 7*d* indicating placement of 59$^{\#2}$, the second, or central, palletized goods. Conveniently, the housing is dimensioned such that the width is slightly in excess of 2.4 m and the depth is slightly in excess of 1.2 m. This permits three Euro pallets, with dimensions of 0.8 m and 1.2 m to be accommodated or to have two 1.2 m×1.2 m pallets side-by-side, using the same exterior shell. As mentioned elsewhere, it is preferable that tri-layer polypropylene corrugated sheet is employed. More preferably, a middle layer is provided with an open three-dimensional structure spaced section, as are known, for example as Akyboard, by DS Smith, being a 3-layer polypropylene panel. With reference to FIG. 7*a*1, there is show a typical board, combining a central thermoformed layer CT and two solid sheets MT & ET with in-line lamination. The central area comprises a pattern of upstanding, interconnected polygons, referred to by DS Smith as an aerated section and contributes to the panel being of high strength yet lightweight. At the end of its useful life, it can be entirely recycled into new products. Such forms of corrugated and extruded material, benefit from having an ability to be bent along one axis of corrugation/heat treatment, yet when returned to a relaxed state, do not show significant indications of having been folded over. Indeed, it is understood that the corners defined in such sheet material acting as exterior and internal wall sections, with the flutings/linear elemental pattern arranged in a vertical orientation. Conveniently, vertical pinch welds in the bubble sheet material thereby creating a flat section which permits personnel to fold the sleeve through almost 330° about the feature. The top and bottom edges of the corrugated sleeve material can also be heated/pinch welded to prevent the ingress of water/debris and also a tapered edge that fits more easily into the recessed channel within lid sections. The lid sections are conveniently formed from a thermoplastics material, where non-planar features can assist in providing rigidity without unnecessary weight. The lid elements may be arranged such that clip together; a first member may be permitted to rotate with respect to the other, for convenience. It has been found suitable to provide exterior walls having a thickness of a 11 m and a weight of 3.5 Kg/m$^2$, with the interior divider walls conveniently being of a lighter weight, such as 6.2 mm and a weight of 1.5 Kg/m$^2$— providing significant weight benefits, given that the weight of the panels for a 2.45×1.24 times 1.18 m enclosure can amount to less than 19 Kg, together with the weight of the thermo formed lids being 10 Kg.

Figure 7I:
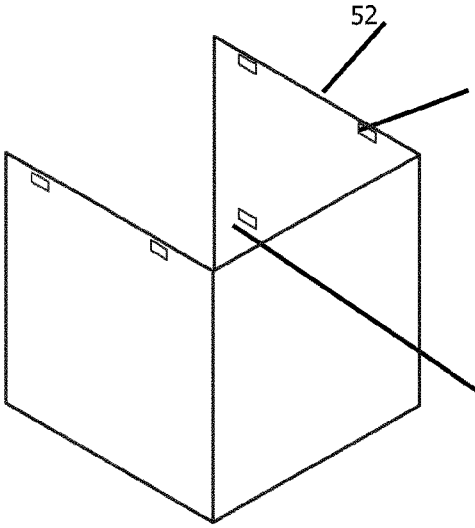
Figure 7J:
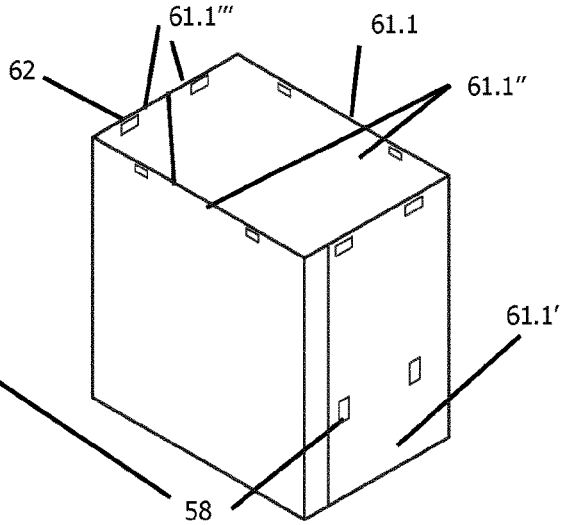
Figure 7K:
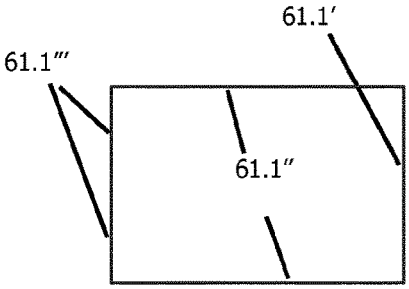
Figure 7M:
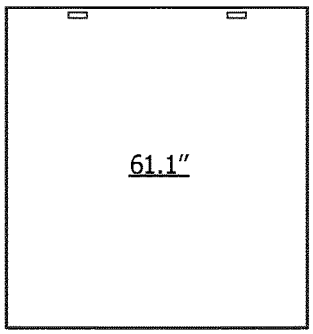
Figure 7N:
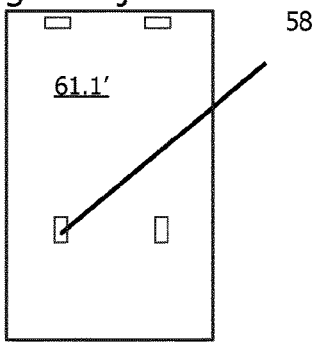
Figure 7L:
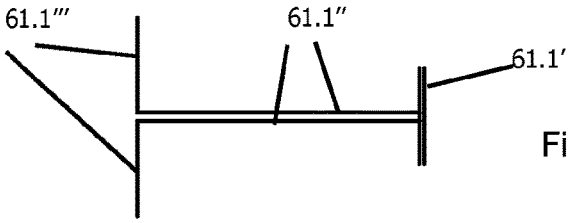

Referring now to FIGS. 7*f*-7*i*, there are shown respectively, a plan view of the outer enclosure 52, an end-on view of the end (middle) panel and side panels and a perspective view. FIG. 7*j* shows a first alternative to a middle enclosure 61.1, comprising an end panel 61.1', two pallet load separator panels 61.1''' and two door elements 61'''. As seen in FIGS. 7*k* and 7*l*, the interior dividing panel permits the enclosure of a single pallet load (of three for an enclosure in accordance the invention or for two larger pallet loads, when the plan view of FIG. 7I is adopter, the thinner corrugate sheet material permitting the corrugate board 61.1' to be folded back upon itself. The views of FIGS. 7*m* and 7*n* show the dividing panels 61.1'' and end panel 61.1' in side view, noting that reference numeral 58 indicates an area for a hook and loop fastener and apertures 62 provide apertures for locking members bolts to pass through, whilst conveniently being providing a secure hand-hold for use in manoeuvring panels upon erection of an enclosure in accordance with the present invention.

Figure 8A:
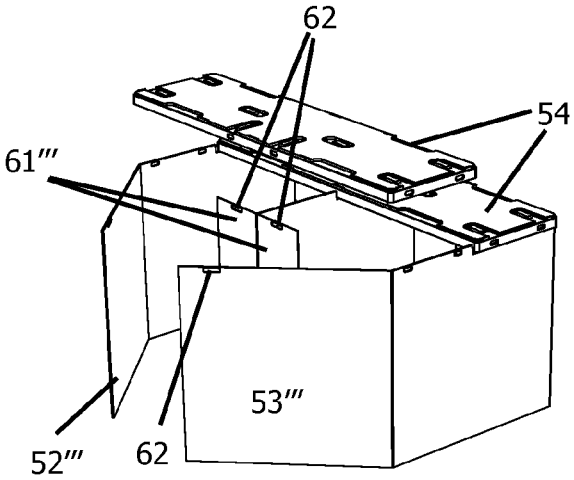
FIG. 8*a* shows a variation in the division of the internal volume.
Figure 8B:
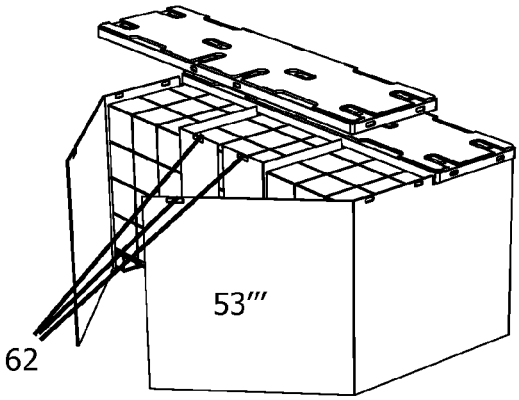
FIG. 8*b*-8*d* show an enclosure with two divisions in various states of closure.
Figure 8D:
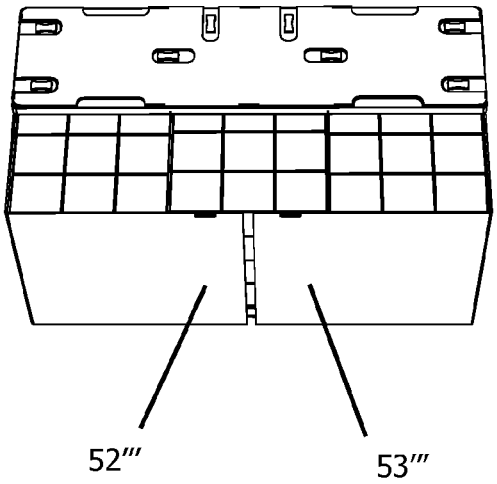
Figure 8C:
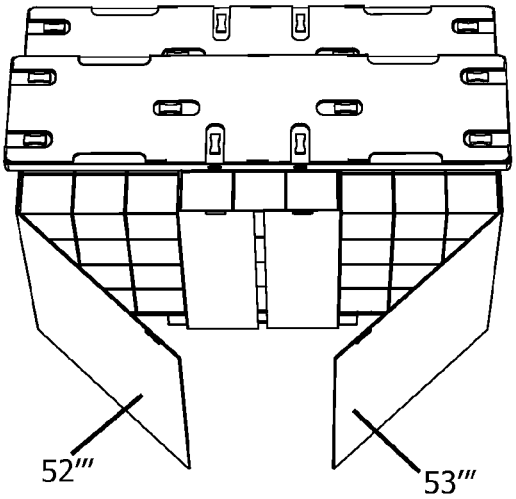
Figure 8E:
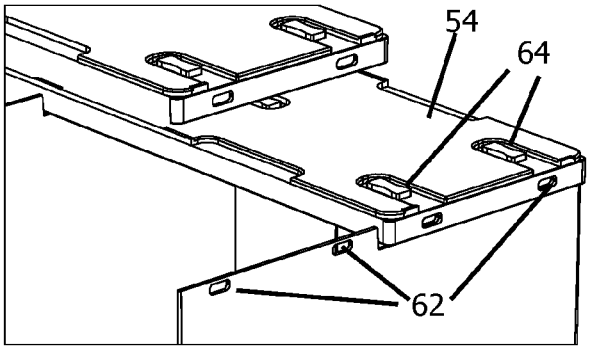
FIG. 8*e* details how the lid and wall components of the present invention can be securely fastened together.

FIG. 8*a* shows how the inside separation corrugated boards 61''' in accordance with the first embodiment—can be interchanged in their relative positions such that they divide the volume into three rather than just two volumes: the "C"-plan of the board 61 is interchanged so that the "C"-plans are now directed away from each other. Whilst no palletized goods are shown, the panels 52''', 53''' are ready to be brought toward the inside walls 61''' of the internal board 61, so that they are parallel with the first set of co-planar panels on the other side of the enclosure, 52', 53' with is directed towards the ends rather than towards themselves. FIG. 8 shows a similar arrangement save for the fact that the load elements $\mathbf{59}^{\#1}$-$\mathbf{59}^{\#3}$ are arranged therein, noting that bolt latch apertures 62 on panels 61''' are aligned with apertures 62 of external panels 52''' and 53'''. FIG. 8*c* shows a front perspective view corresponding to the side perspective view of FIG. 8*b*; FIG. 8*d* shows the panels 52''' and 53''' parallel with the sides of the palletized goods. FIG. 8*e* shows in detail how the bolt elements 64 are arranged to locate with apertures 62 proximate to an upper edge surface of panel 53''.

Figure 9A:
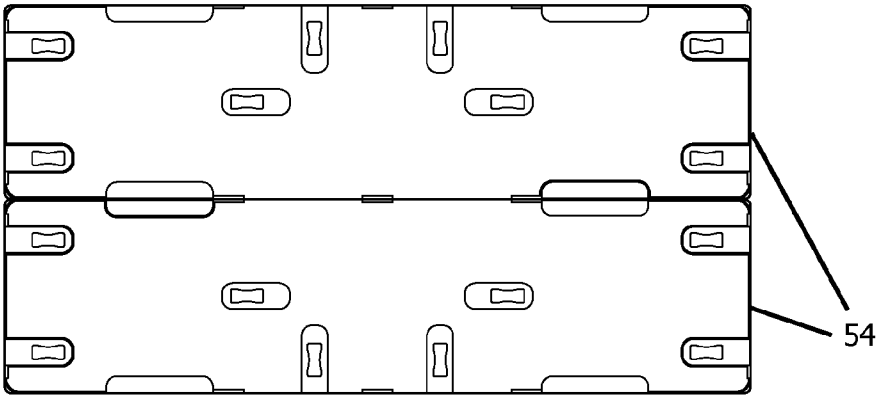
FIG. 9*a*-9*a*" show a top plan view, a side view and an underside plan view of a lid arrangement.
Figure 9A:
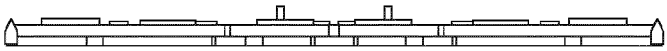
Figure 9B:
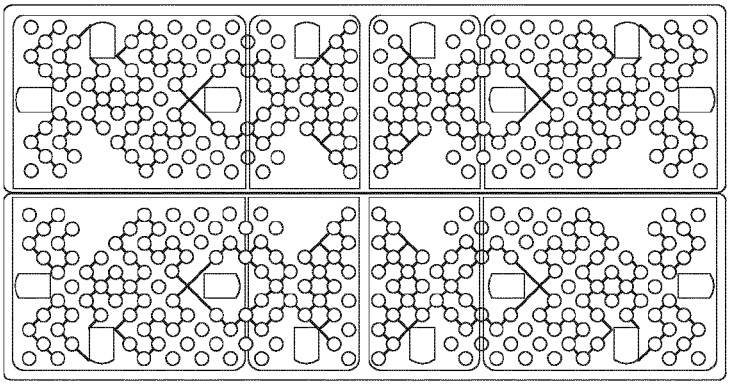
FIGS. 9*b* and 9*c* show how the internal walls can be placed to divide the internal volume of an enclosure in accordance with the present invention.
Figure 9B:
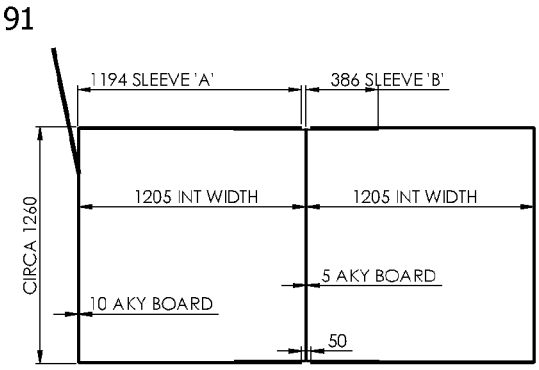
Figure 9C:
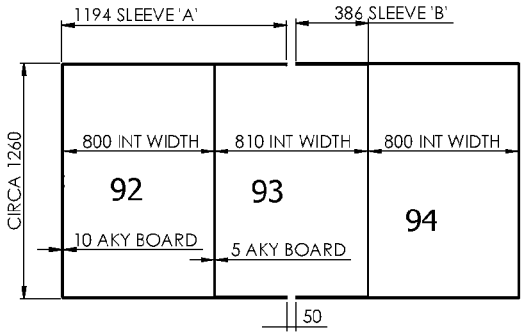

FIG. 9*a* shows two panels 54 sufficient to enclose different loads FIGS. 9*a'* and 9*a''* show a side view and underside view of this embodiment, respectively. With reference to FIG. 9*b*, the overall enclosure footprint 91 dimensions of 1275 depth×2475 width enable typical 40"×48" (1200 mm×1200 mm) pallets to be enclosed in use, whilst an arrangement of three pallets is possible if using a Euro-pallet with dimensions of 1200 mm×800 mm. It will be appreciated that the locking bolts 64 can be provided with tamper evident fasteners/tags to ensure that any opening of an enclosure in accordance with the invention is indicated whereby to confirm a possibility that the enclosure assembly has been tampered with. Equally locking bolt mechanisms could also be provided. Other features that could be implemented include the provision of hand-hold apertures within the side wall panels, to assist in placement thereof. It will be appreciated by having one cover for up to three pallets, the protection of loads can be facilitated by the present invention. Referring back to FIGS. 5*d* & 5*c*, it is shown how, upon fabrication, a second set of three pallets 59, together with load can be placed upon the base enclosure system 51.

The panels are conveniently formed from materials such as corrugated cardboard sheet and corrugated plastics sheet which are widely employed in the packaging industry. It will be appreciated that by the use of corrugated sheet materials, the sheets have a good degree of rigidity, which is of benefit in a number of areas, for example in the provision of the apertures 62 and other features defined in the side panels.

Figure 10A:
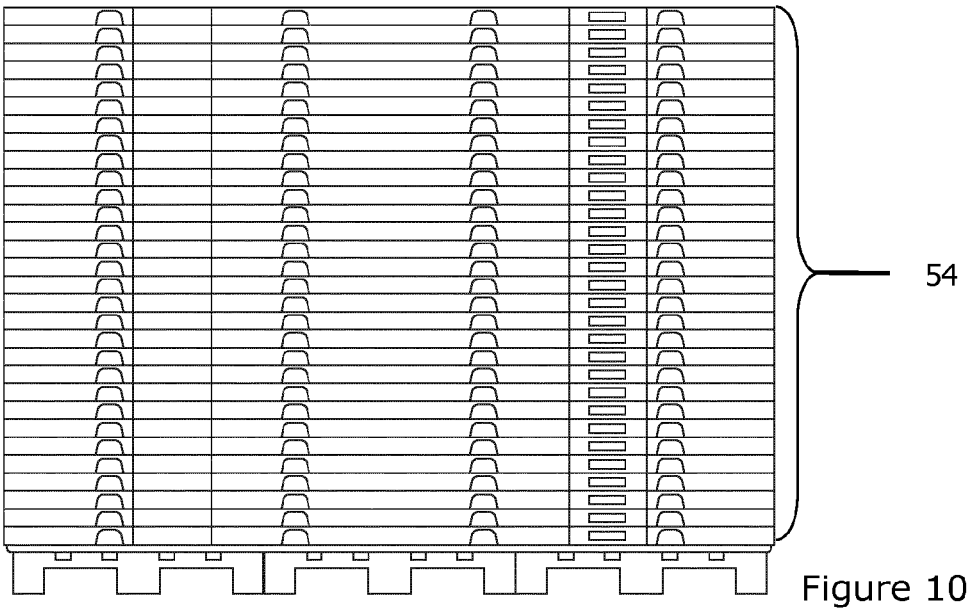
FIG. 10*a* shows a stack of lids.
Figure 10B:
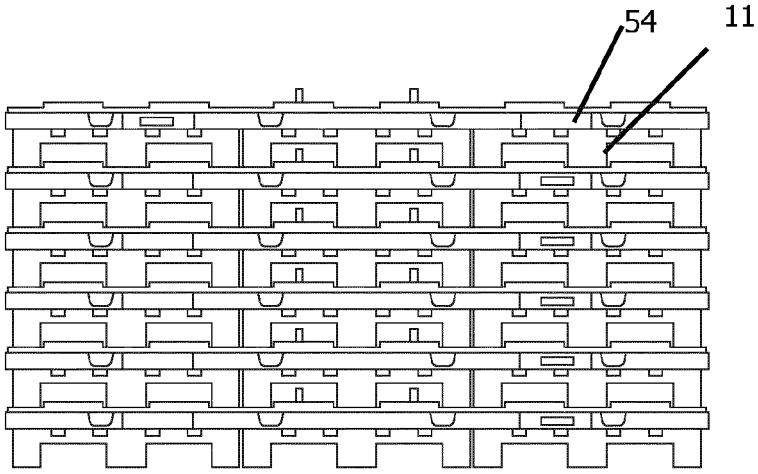
FIGS. 10*b*-10*e* show how six lid-pallet kits can be stacked, two types of pallet respectively of wood and moulded plastics; and, FIGS. 11*a* to 11*f* show first and side views of a system in accordance with the invention in use, with plan and perspective views thereof with different types of pallet.
Figure 10C:
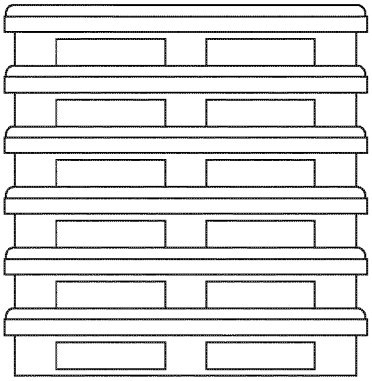
Figure 10D:
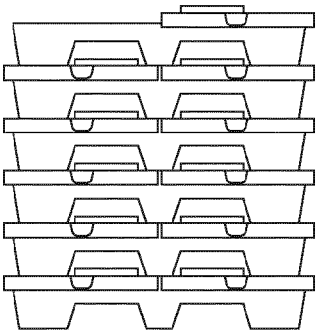
Figure 10E:
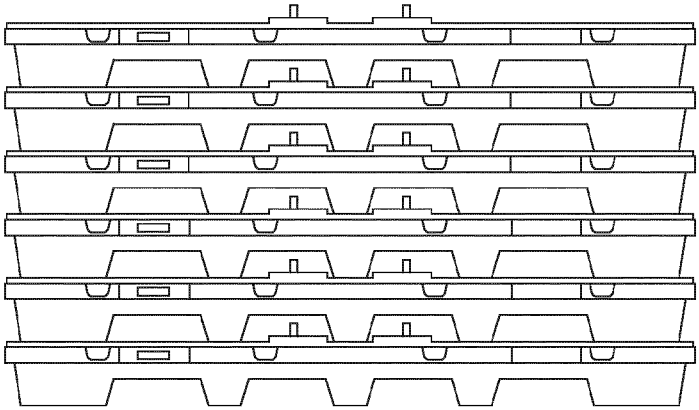
Figure 11A:
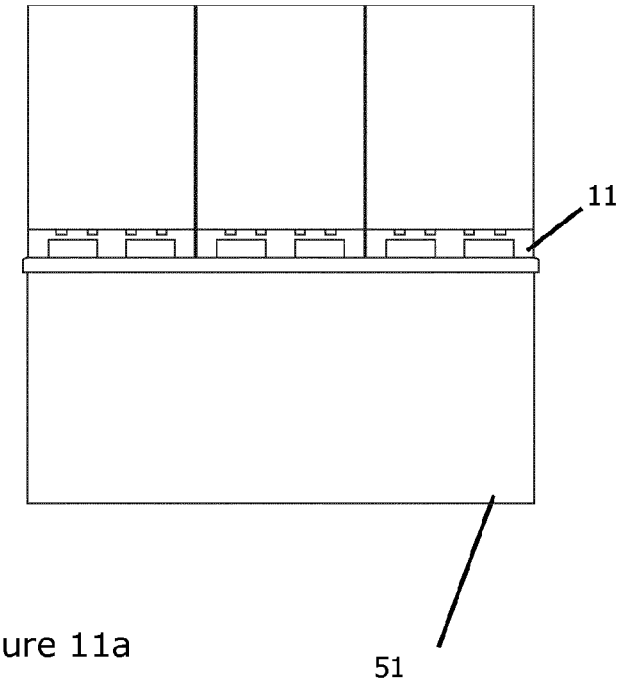
Figure 11B:
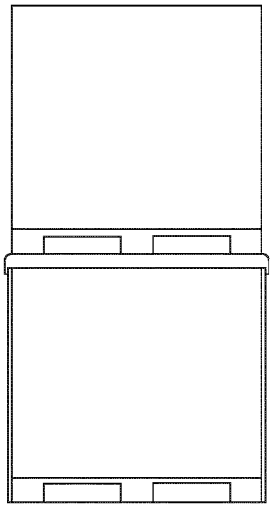
Figure 11C:
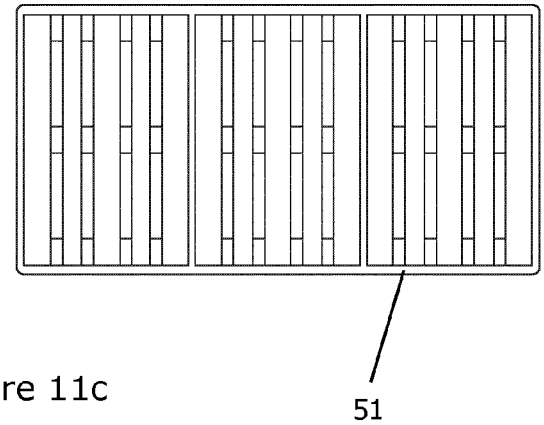
Figure 11D:
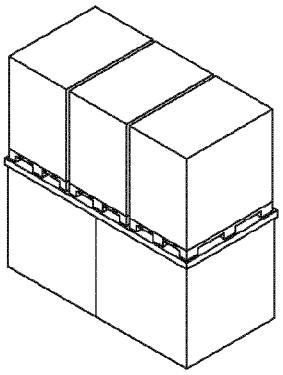
Figure 11E:
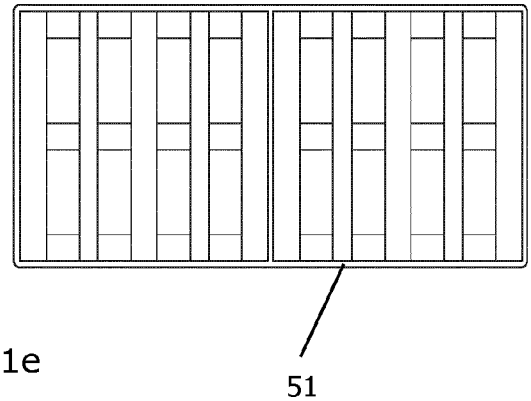
Figure 11F:
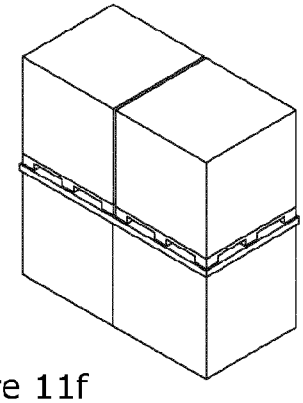

FIG. 10*a* shows how a stack of thirty lids 54 can be placed one atop another. It will be appreciated that the displacement of a minimal volume of return and storage purposes can be extremely beneficial and advantageous from a reduced "dead space" requirement for such return travel and storage issues. The height of the stack, together with a pallet of standard dimensions has been shown to be less than 1.9 meters. FIGS. 10*b*-10*e* show how six kits can be stacked, with each kit comprising a lid and pallet. Dependent on the height, strength and stability of the assemblies and the ability of the operator to see clearly, taller stacks may only be built following detailed consultation with the manufacturer or other competent authority. FIGS. 11*a* and 11*b* show how an enclosure in accordance with the invention can be employed simply as a base enclosure 51 upon which a further arrangement of pallets 11 can be placed, FIG. 11*b* being a cross-section through FIG. 11*a* at H-H. The pallets employed in a system may well be pre-existing pallets. Equally, the present invention may be distributed as a complete system including the pallets, which may well be formed from a plastic material such as polypropylene, as is known. FIGS. 11*c*-11*f* show how plan views of pallets correspond, and how the same external dimension of enclosure so easily accommodate different types of pallets in differing arrangements.

In the manufacture of development products, high performance corrugated board specifically developed for heavy-duty packaging applications. There are typically several standard board grades, and widths ranging from 3 mm, to 15 mm, with differentiators including the weight of the papers and the flute profiles, as well as the number of corrugations, the use of wet strength resins and wet strength adhesives to give good-excellent performance in moist or humid conditions. It has been found to be satisfactory to employ 11 mm (7/16") thick panels from polypropylene with regard to the outer panels—equating to a weight of 0.35 $kgm^{-2}$ and 6.2 mm (¼") thick, with a corresponding weight of 0.15 $kgm^{-2}$. It is also possible to coat the board to provide further moisture protection, for example. The present invention can thus provide a simple to erect yet secure enclosure for a load, conveniently placed upon a pallet. Therefore the load is shielded from dust and other interference; the load cannot be tampered with easily and further loads can be placed upon the cover.

Cardboard panels can also be used in addition to plastics corrugated materials. Cardboard for use in the present invention can be reinforced to a degree suitable for purpose: conveniently, the cardboard sleeve is made from industry standard single, double, triple or quadruple corrugated cardboard. In view of the ability of untreated cardboard to absorb water from precipitation or from the atmosphere, the cardboard should be adequately treated, by wax, resin, paint or other known waterproofing methods. When using corrugated board formed from 440 $gm^{-2}$ wet strength Kraft paper, this type of board has a weather resistance which satisfies a 2 hour water immersion test without any ply separation. This can benefit the recyclability of the product.

In addition to a requirement for waterproofing, in order to strengthen the material, one or more of a number of options may be selected: the number of layers of sheets may be increased—e.g. for a corrugated board, the sheets as a whole, or merely just the corner sections, can be reinforced so that they have two, three of more layers; any corrugated flutes could be filled with elongate support members or strengthening members, which could be plastic rod, metal, wood or any of a number of alternative materials which can be placed within the corrugation flutes, conveniently glued or otherwise permanently attached.

Whilst the present invention enables greater flexibility in the positioning of loads with respect to a support surface and a stacking thereof, such stacking should only be performed subject to the ability of a storage/distribution warehouse/facility floor, flat bed of a commercial vehicle or base-level transport/storage assemblies to take additional weight. It is to be noted that the enclosure in accordance with the present invention is capable of providing a rectangular surround for a product to be transported or stored and will always cooperate with a corresponding support surface.

The invention claimed is:

1. A transport/storage enclosure for enclosing a product with respect to a support surface, the enclosure comprising:

at least first and second rectangular sheet products configured to form a rectangular enclosure, each comprising first and second fold lines configured to produce a panel having first, second, and third rectangular wall sections, wherein the first and second rectangular sheet products upon assembly each have a cross-section of a general "C"-shape, wherein the first and second rectangular sheet products collectively define a main opening of the rectangular enclosure;

a third rectangular sheet product, comprising first and second fold lines configured to produce a panel having first, second, and third rectangular wall sections, wherein the third rectangular sheet product upon assembly has a cross-section of a general "C"-shape, wherein a length of the first and third wall sections of the third rectangular sheet product is less than the corresponding wall section of the first and second rectangular sheet products, wherein the third rectangular sheet product divides the main opening into at least first and second openings, with the first and third wall sections being placed parallel to the corresponding wall sections of the first and second rectangular sheet products; and a lid configured to close the rectangular enclosure, the lid having a downwardly depending lip about its perimeter and channels operable to engage with upstanding edges of at least one of the first, second, and third rectangular sheet products, to define an upright rectangular quadrangle arrangement operable to surround two or more pallets and any load carried thereon, the lid including first and second parts separable along a lengthwise edge of the first and second parts.

2. The transport/storage enclosure of claim 1, wherein the third rectangular sheet product is operably arranged to connect the first and third rectangular wall sections of the first and second rectangular sheet products to act as a divider between the first and second openings for palletized goods.

3. The transport/storage enclosure of claim 1, further comprising another third rectangular sheet product, wherein the two third rectangular sheet products each form a general "C"-shape in plan, wherein the two third rectangular sheet products are operably arranged in a first mode of operation such that the C-sections face each other to divide the enclosure into three openings that include the first and second openings and in a second mode of operation are arranged such that the "C"-sections are facing away from each other to divide the rectangular enclosure into the first and second openings.

4. The transport/storage enclosure of claim 1, wherein at least one of the first, second, and third rectangular sheet products is formed from one of corrugated cardboard, corrugated plastics, extruded plastics and multi-layered plastics.

5. The transport/storage enclosure of claim 1, wherein the lid includes slide mechanisms operable to engage with apertures placed proximate to upstanding edges of at least one of the first, second, and third rectangular sheet products.

6. The transport/storage enclosure of claim 5, wherein the slide mechanisms include locks operable to secure the lid to at least one of the first, second, and third rectangular sheet products.

7. The transport/storage enclosure of claim 1, wherein removal of the first part of the lid permits the rectangular enclosure to remain secure yet permit the rectangular enclosure to be hingedly opened, to enable access to at least one of the first and second openings of the rectangular enclosure.

8. The transport/storage enclosure of claim 1, wherein the sheet materials employed for the fabrication of the first and second rectangular sheet products are selected from corrugated cardboard and/or corrugated plastics.

9. The transport/storage enclosure of claim 1, wherein the two parts of the lid are provided with handles that can be stowed flat.

10. The transport/storage enclosure of claim 1, wherein each of the first, second, and third rectangular sheet products are formed from one of corrugated cardboard, corrugated plastics, extruded plastics and multi-layered plastics.

11. The transport/storage enclosure of claim 1, wherein the lid includes slide mechanisms operable to engage with apertures placed proximate to upstanding edges of each of the first, second, and third rectangular sheet products.

* * * * *